US007095306B2

(12) United States Patent
Kato et al.

(10) Patent No.: US 7,095,306 B2
(45) Date of Patent: Aug. 22, 2006

(54) IGNITION COIL HAVING RIGID MOUNTING STRUCTURE

(75) Inventors: Hideyuki Kato, Nishio (JP); Yoshitaka Sato, Toyohashi (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/220,593

(22) Filed: Sep. 8, 2005

(65) Prior Publication Data

US 2006/0061446 A1 Mar. 23, 2006

(30) Foreign Application Priority Data

Sep. 17, 2004 (JP) ..... 2004-271285
Jul. 28, 2005 (JP) ..... 2005-218606

(51) Int. Cl.
*H01F 27/02* (2006.01)

(52) U.S. Cl. ..... 336/90

(58) Field of Classification Search ..... 336/65, 336/90–96, 107, 192, 198; 123/634–635
See application file for complete search history.

(56) References Cited

U.S. PATENT DOCUMENTS 5,335,642 A * 8/1994 Hancock et al. ..... 123/634
5,685,065 A * 11/1997 Suzuki et al. ..... 29/606
6,011,457 A * 1/2000 Sakamaki et al. ..... 336/96
6,094,121 A * 7/2000 Sakamaki et al. ..... 336/96
6,340,303 B1 1/2002 Hamada et al.
2002/0145429 A1* 10/2002 Yorita et al. ..... 324/380

* cited by examiner

*Primary Examiner*—Tuyen T Nguyen
(74) *Attorney, Agent, or Firm*—Nixon & Vanderhye P.C.

(57) ABSTRACT

An ignition coil includes a cylindrical portion that includes a primary coil and a secondary coil, which are coaxially wound. The cylindrical portion can be inserted into a plugh-ole of an engine. The cylindrical portion has a tip end in an axial direction thereof. The tip end of the cylindrical portion has a plug mounting hole, into which a sparkplug is mounted. The plug mounting hole accommodates a high voltage terminal, which electrically connects with one of the secondary coil, and a coil spring, which makes contact with the high voltage terminal. The cylindrical portion has a base end portion in one axial end thereof. The base end portion of the cylindrical portion includes at least one flange portion. The at least one flange portion radially outwardly protrudes. The at least one flange portion has multiple bolt insertion holes, through which a bolt is respectively inserted.

14 Claims, 12 Drawing Sheets

IGNITION COIL HAVING RIGID MOUNTING STRUCTURE

CROSS REFERENCE TO RELATED APPLICATIONS

This application is based on and incorporates herein by reference Japanese Patent Applications No. 2004-271285 filed on Sep. 17, 2004 and No. 2005-218606 filed on Jul. 28, 2005.

FIELD OF THE INVENTION

The present invention relates to an ignition coil for generating a spark in a sparkplug. More particularly, the present invention relates to an ignition coil having an ion current detecting device.

BACKGROUND OF THE INVENTION

An ignition coil is mounted to a cylinder of an internal combustion engine of a vehicle or the like. The ignition coil is electrically connected with a sparkplug to generate a spark in a combustion chamber of a cylinder. When fuel is burned in the combustion chamber, fuel is ionized, so that ion current flows between electrodes of the sparkplug. The ion current is detected to evaluate whether miss fire arises in the combustion chamber.

Ion current flowing between the electrodes of the spark plug is significantly small. Therefore, a specific condition needs to be satisfied to stably detect the ion current.

For example, as disclosed in U.S. Pat. No. 6,340,303 (JP-A-2001-85139), a sparkplug is electrically connected with a secondary coil in an ignition coil. A spring member (coil spring) is interposed between a spring supporting portion of a high voltage terminal and a head portion of the sparkplug. The spring supporting portion rises from an inner wall of the high voltage terminal, which is provided to a plug mounting hole of the ignition coil. In this structure, the spring member maintains a contact condition between the spring supporting portion and the head portion of the sparkplug, so that an instantaneous disconnection is restricted thereamong.

However, when external force such as vibration is applied to the ignition coil, the spring member vibrates between the high voltage terminal and the sparkplug. Therefore, a contact condition between the high voltage terminal and the spring member varies, and a contact condition between the sparkplug and the spring member also varies. As a result, electric resistance may change among these components.

Furthermore, an ignition coil have a following problem, regardless of whether the ignition coil includes an ion current detecting function or not. When a spring member vibrates between a high voltage terminal and a sparkplug, abrasion may be caused thereamong. As a result, abrasion powder is formed thereamong, and the abrasion power is oxidized. The oxidized abrasion power may become an electrically insulative matter. When oxidized abrasion power is interposed among the spring member, the high voltage terminal, and the sparkplug, electrical conductivity may become insufficient among the components.

SUMMARY OF THE INVENTION

In view of the foregoing and other problems, it is an object of the present invention to produce an ignition coil that is capable of effectively restricting abrasion arising among a coil spring, a high voltage terminal, and a sparkplug.

According to one aspect of the present invention, an ignition coil includes a cylindrical portion. The ignition coil may include an ion current detecting device. The cylindrical portion includes a primary coil and a secondary coil. The secondary coil is wound coaxially with respect to the primary coil. The ion current detecting device detects ion current. The cylindrical portion is capable of being inserted into a plughole of an internal combustion engine. The cylindrical portion has a tip end in an axial direction of the cylindrical portion. The tip end of the cylindrical portion has a plug mounting hole, into which a sparkplug is mounted. The plug mounting hole accommodates a high voltage terminal that electrically connects with the secondary coil. The plug mounting hole accommodates a coil spring that makes contact with the high voltage terminal. The cylindrical portion has a base end portion in one end with respect to the axial direction of the cylindrical portion.

The base end portion of the cylindrical portion includes at least one flange portion. The at least one flange portion outwardly protrudes in a radial direction of the cylindrical portion. The at least one flange portion has multiple bolt insertion holes, through which a bolt is respectively inserted.

Alternatively, the base end portion of the cylindrical portion includes one flange portion. The one flange portion outwardly protrudes in a radial direction of the cylindrical portion. The one flange portion has multiple bolt insertion holes, through which a bolt is respectively inserted.

Alternatively, the base end portion of the cylindrical portion includes multiple flange portions. The multiple flange portions outwardly protrude in a radial direction of the cylindrical portion. Each of the multiple flange portions has one bolt insertion hole, through which a bolt is inserted.

Alternatively, the base end portion of the cylindrical portion includes multiple hooking portions that respectively hook around the opening of the plughole of the internal combustion engine. The multiple hooking portions outwardly protrude in a radial direction of the cylindrical portion. The multiple hooking portions are formed in locations, which are apart from each other in a circumferential direction of the cylindrical portion. In this structure, the multiple hooking portions may include at least one flange portion and at least one hooking protrusion. The at least one flange portion outwardly protrudes from the base end portion of the cylindrical portion in a radial direction of the cylindrical portion. The at least one flange portion respectively has at least one bolt insertion hole, through which a bolt is respectively inserted. The at least one hooking protrusion hooks to a hooked claw that is provided around the opening of the plughole of the internal combustion engine.

Thereby, rigidity of the structure, in which the ignition coil is mounted to the engine, can be significantly enhanced, so that the ignition coil can be restricted from vibrating, even when external force such as vibration acts to the ignition coil. Thereby, even when the ignition coil mounted to the internal combustion engine receives external force, the spring member, the high voltage terminal, and the spark plug can be effectively protected from causing abrasion thereamong.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
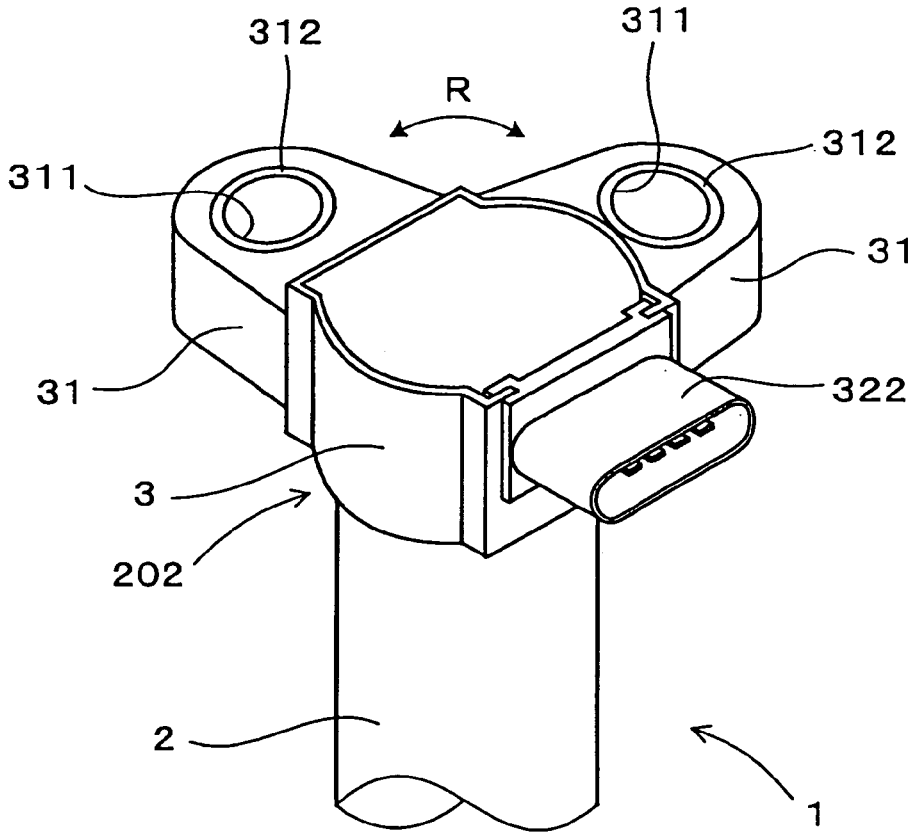
FIG. 1 is a perspective view showing an ignition coil according to a first embodiment of the present invention.

As shown in FIGS. 1 to 5, an ignition coil 1 includes a cylindrical portion 2 and an ion current detecting device (ion current detecting function). The cylindrical portion 2 accommodates a primary coil 21 and a secondary coil 22 that are wound coaxially to each other. The cylindrical portion 2 can be inserted into a plughole 71 of an engine 7. The cylindrical portion 2 includes an axial end portion 201 that has a plug mounting hole 26, into which a spark plug 6 is mounted. The plug mounting hole 26 is provided with a high voltage terminal 27 and a coil spring 28. The high voltage terminal 27 is electrically connected with one end (high voltage end) of the secondary coil 22. The coil spring 28 makes contact with the high voltage terminal 27.

The cylindrical portion 2 includes an axial base portion 202 that has two flange portions 31, which radially outwardly protrude. Each flange portion 31 has a bolt insertion hole 311, through which a bolt 4 is inserted.

The axial end portion 201 is arranged on the side, on which the cylindrical portion 2 is located in the plughole 71 when the cylindrical portion 2 is inserted into the plughole 71. The axial base portion 202 is arranged on the side, on which the cylindrical portion 2 is not accommodated in the plughole 71 when the cylindrical portion 2 is inserted into the plughole 71.

Next, the structure of the ignition coil 1 is described in detail in reference to FIGS. 1 to 7.

Figure 4:
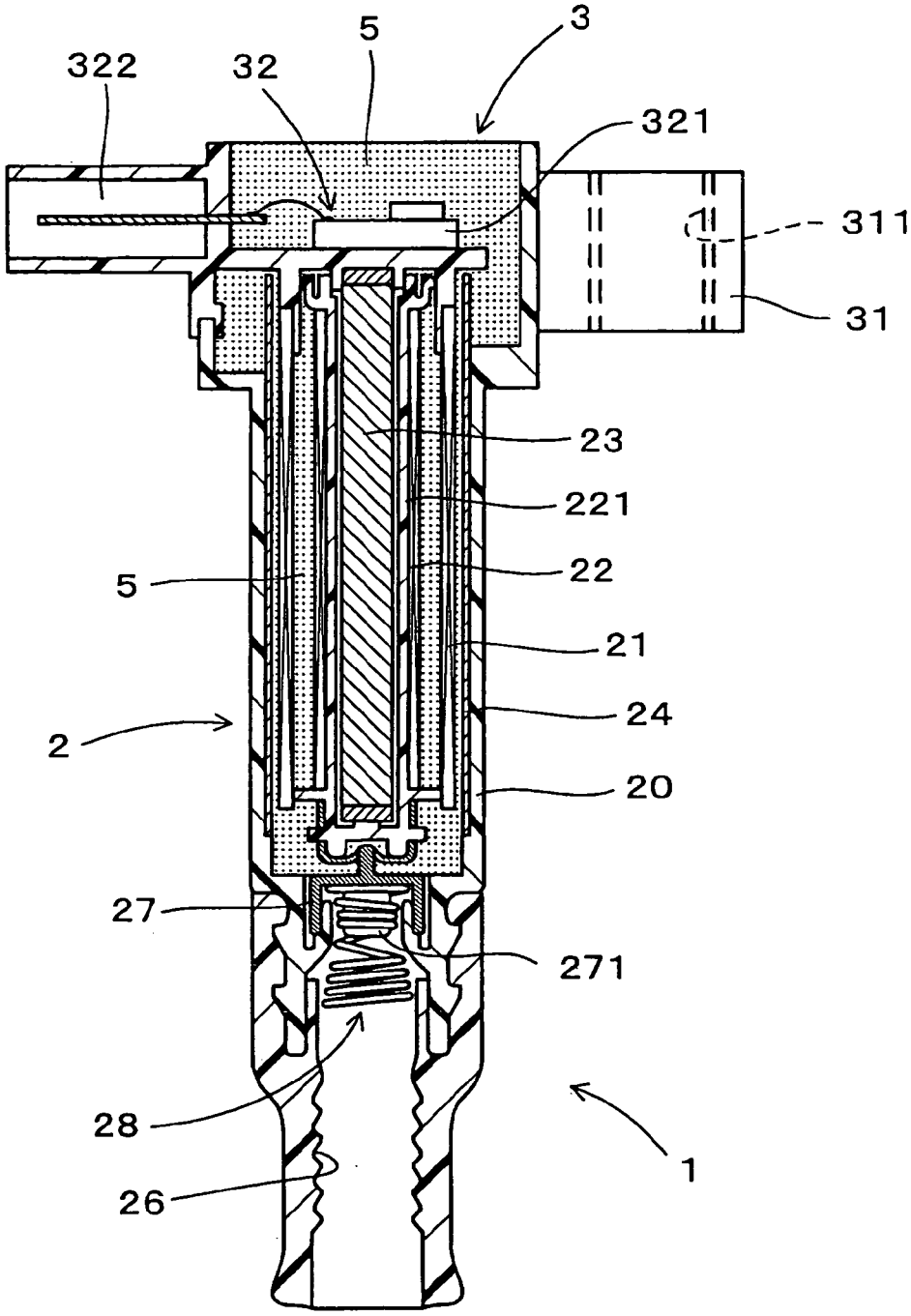
FIG. 4 is a partially cross sectional side view showing the ignition coil accommodating a primary coil and a secondary coil, according to the first embodiment.

As shown in FIG. 4, the cylindrical portion 2 is constructed of a coil case 20, into which an outer core 24, the primary coil 21, the secondary coil 22, and a center core 23 are inserted. Specifically, the primary coil 21 is formed of a wire, which is coated with an electrically insulative material. The wire is wound to be in a cylindrical shape, so that the primary coil 21 is formed.

The secondary coil 22 is also formed of a wire, which is coated with an electrically insulative material. The wire of the secondary coil 22 is wound around the outer periphery of a secondary spool 22, which is in a cylindrical shape. The wire of the secondary coil 22 is wound for a number of turns that is greater than a number of turns of the primary coil 21.

The secondary spool 22 is inserted inside the inner periphery of the primary coil 21, so that the center core 23 is arranged on the inner peripheral side of the secondary coil 22. The center core 23 is formed of electromagnetic steel plates, which are in a substantially stick-shape. The outer core 24 is inserted into the coil case 20.

The primary coil 21 is supplied with electricity, so that the primary coil 21 generates magnetic flux that passes through the center core 23 and the outer core 24. Thereby, the magnetic flux can be amplified in the ignition coil 1.

The primary coil 21 is formed in the following manner, in this embodiment. The winding, which is coated with the electrically insulative material, is wound to be in a cylindrical shape, subsequently the wound wires are bonded by welding medium or the like to be in a cylindrical shape. Alternatively, the primary coil 21 may be formed in such a manner that the electrically insulative wire is wound around the outer periphery of a cylindrical primary spool to be in a cylindrical shape.

Electrically insulative resin 5 is filled in a gap formed between the center core 23 and the secondary coil 22, a gap formed between the secondary coil 22 and the primary coil 21, and a gap formed between the primary coil 21 and the outer core 24. The axial base portion 202 of the coil case 20 is formed with an igniter recession 3, in which an igniter 32 is mounted. The igniter 32 supplies electricity to the primary coil 21. The igniter recession 3 is filled with electrically insulative resin 5 in a condition, in which the igniter 32 is set in the igniter recession 3. The electrically insulative resin 5 filled in the igniter recession 3 is equivalent to the electrically insulative resin 5 filled in the above gaps formed among the center core 23, the secondary coil 22, the primary coil 21, and the outer core 24. The igniter 32 is electrically connected with a substrate 321 that includes an electric power control circuit and an ion current detecting circuit. The electric power control circuit is constructed of a switching element or the like. The electric power control circuit is operated by a signal transmitted from an electronic control unit (ECU). The ion current detecting circuit detects ion current flowing between electrodes of the spark plug 6.

When the ECU outputs a spark generating signal to the substrate 321, the switching element in the substrate 321 generates electricity transmitted to the primary coil 21, so that the secondary coil 22 generates induced electromotive force (counterelectromotive force) by electromagnetic induction. Thus, the spark plug 6 can generate a spark.

Figure 5:
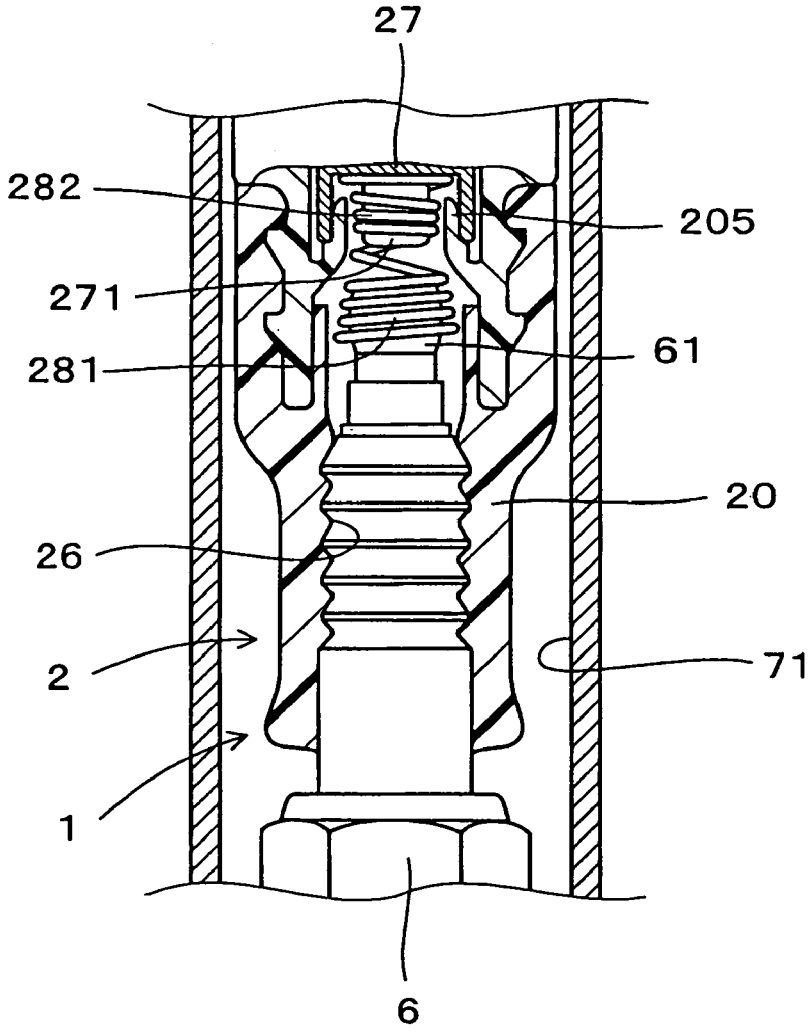
FIG. 5 is a partially cross sectional side view showing the ignition coil connected with a sparkplug, according to the first embodiment.

As referred to FIGS. 4, 5, the high voltage terminal 27 is formed with a protrusion 271 that protrudes to the opening formed in the tip end of the plug mounting hole 26, in this embodiment. The inner periphery of the coil sprig 28 is pres-inserted to the protrusion 271, so that the coil sprig 28 is electrically connected with the high voltage terminal 27.

The coil spring 28 has a tip end 281 that can electrically make contact with a head portion 61 of the spark plug 6. Specifically, the tip end 281 of the coil spring 28 has a shape such that the tip end 281 can cover the outer periphery of the head portion 61 of the spark plug 6.

More, specifically, the outer periphery of the head portion 61 of the spark plug 6 is formed to be in a substantially round shape. The tip end 281 of the coil spring 28 is formed of a copper wire or the like. The tip end 281 of the coil spring 28 is wound such that the diameter of the coil spring 28 becomes larger to the side of the tip end 281 of the coil spring 28. Thereby, the tip end 281 of the coil spring 28 covers the outer periphery of the head portion 61 of the spark plug 6.

The high voltage terminal 27 is formed in a substantially cup shape that is formed of a bottom portion and an annular sidewall portion. The annular sidewall portion is substantially annularly raised from the bottom portion of the high voltage terminal 27. The coil spring 28 has a base end portion 282 that that is retained by a retaining protrusion 205 in a condition, in which the base end portion 282 of the coil spring 28 is received in the high voltage terminal 27. Thereby, the coil spring 28 is restricted from dropping out of the high voltage terminal 27.

Figure 2:
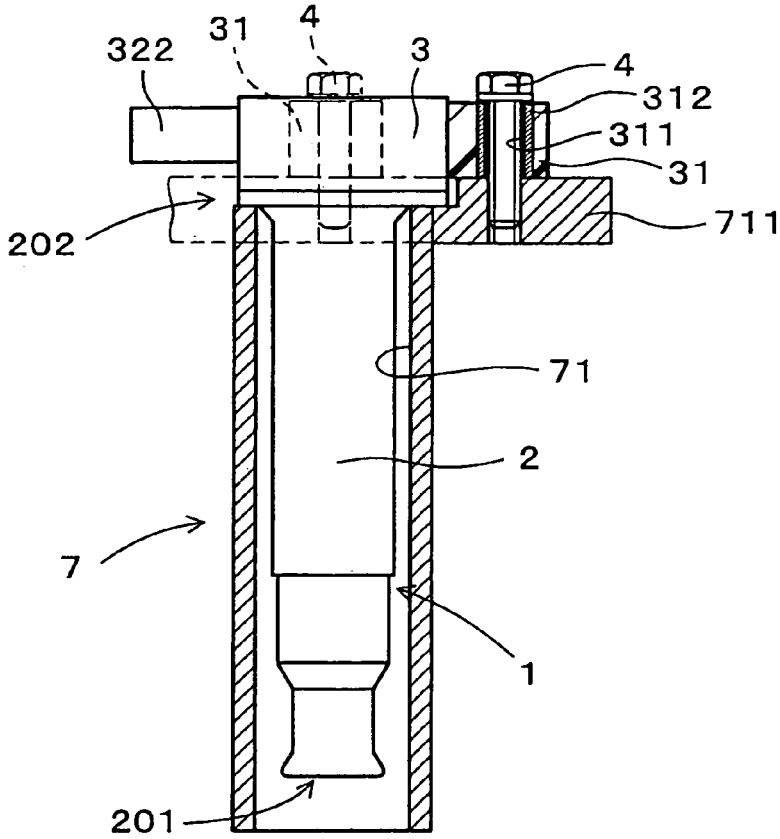
FIG. 2 is a partially cross sectional side view showing the ignition coil received in a plughole, according to the first embodiment.
Figure 3:
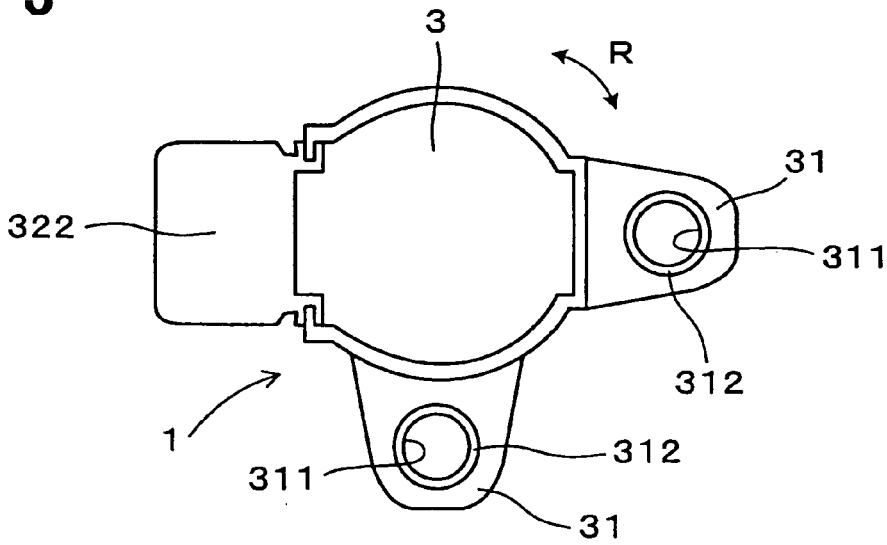
FIG. 3 is a top view showing the ignition coil, according to the first embodiment.

As referred to FIGS. 1 to 3, the flange portions 31 radially protrude outwardly with respect to the igniter recession 3 of the coil case 20. A through hole is formed in each flange portion 31, and a metallic cylindrical member is inserted into the through hole of the flange portion 31, so that each bolt insertion hole 311 is formed.

The igniter 32 has a connector portion 322 that electrically connects with an external power source. The connector portion 322 radially protrudes outwardly with respect to the igniter recession 3. The flange portions 31 are arranged in two locations along the circumferential direction R of the igniter recession 3. The flange portions 31 are arranged in the two locations that are different from the location, in which the connector portion 322 is arranged. The locations of the flange portions 31 are not limited to the above structure. The flange portions 31 may be provided at any locations, in which the flange portions 31 do not interfere with the connector portion 322.

The ignition coil 1 has the cylindrical portion 2, which is inserted into the plughole 71. The bolts 4 are respectively inserted into the bolt insertion holes 311 of the flange portions 31. The bolts 4 are respectively screwed to an engine-side flange portion 711, which is formed around the plughole 71 in the engine 7. Thus, the ignition coil 1 is mounted to the engine 7. In this structure, the ignition coil 1 is mounted to the engine 7 via multiple bolts 4, so that strength, i.e., rigidity of the mounting structure of the ignition coil 1 becomes high.

When the spark plug 6 is mounted to the plug mounting hole 26, the spark plug 6 makes contact with the coil spring 28, so that electricity is supplied from the high voltage end of the secondary coil 22 to the spark plug 6 via the high voltage terminal 27 in this structure of the ignition coil 1. When the spark plug 6 is mounted in the plug mounting hole 26, the coil spring 28 is compressed, so that the coil spring 28 conducts electricity between the high voltage terminal 27 and the spark plug 6, while the coil spring 28 applies predetermined compression force to both the high voltage terminal 27 and the spark plug 6.

When the ECU outputs the signal to the electric power control circuit of the substrate 321 of the igniter 32, the electric power control circuit supplies electricity to the primary coil 21. The secondary coil 22 generates high voltage by electromagnetic induction, so that electricity flows to the spark plug 6 through the high voltage terminal 27 and the coil spring 28. Thus, electrodes of the spark plug 6 generate spark therebetween. Combustion is generated in the engine 7, and the ion current detecting circuit of the substrate 321 detects ion current between the electrodes of the spark plug 6 via the high voltage terminal 27 and the coil spring 28. In this situation, the ignition coil 1 is secured to the engine 7 using multiple volts 4, so that the ignition coil 1 can be restricted from vibrating, even when external force such as vibration is applied to the ignition coil 1.

Thus, the coil spring 28 can be restricted from vibrating between the high voltage terminal 27 and the spark plug 6. Therefore, the condition of contact between the high voltage terminal 27 and the coil spring 28 and the condition of contact between the spark plug 6 and the coil spring 28 can be restricted from changing, even when external force such as vibration is applied to the ignition coil 1. Thus, electric resistance therebetween can be restricted from changing. In this embodiment, the mounting structure of the ignition coil 1 is significantly improved compared with the structure, in which the ignition coil 1 is secured using one bolt, so that accuracy of detecting ion current can be significantly enhanced.

The ignition coil 1 in this embodiment has a simple structure, in which the multiple bolt holes 311 are formed in the flange portions 31. In this improvement in the structure of the ignition coil 1, the ion current detecting circuit of the substrate 321 can steadily detect slight current flowing between the electrodes of the spark plug 6 in a stable condition.

When the ignition coil mounted to the engine 7 is used, vibration of the coil spring 28 arising between the high voltage terminal 27 and the spark plug 6 can be restricted in the above structure. Thereby, even when the ignition coil 1 mounted to the engine 7 receives external force, the coil spring 28, the high voltage terminal 27, and the spark plug 6 can be effectively protected from causing abrasion thereamong.

As described above, in the structure of the ignition coil 1, the coil spring 28 can be effectively protected from causing abrasion relative to the high voltage terminal 27 and the spark plug 6 in the significantly simple structure, which is improved from the structure, in which only one bolt is used to secure the ignition coil to the engine.

The following experiments are conducted to confirm the mounting strength of the ignition coil 1, which is mounted using the two bolts 4 in this embodiment of the present invention. Besides, similar experiment is conducted as a comparison to confirm the mounting strength of an ignition coil, which is mounted using only one bolt in a conventional structure.

Specifically, the ignition coil 1 in this embodiment and the conventional ignition coil are respectively mounted to the engine 7. When predetermined force is applied to tip end portions of the above ignition coils, flexure of the ignition coil in this embodiment is about 40% to 50% of flexure of the conventional ignition coil. As a result, it is proven that the ignition coil in this embodiment can effectively restrict vibration of the coil spring 28, through the above experiment.

In this embodiment, the flange portion 31 is provided to the two locations, which are apart for about 90° along the circumferential direction R of the igniter recession 3. The angle between the centers of the bolt insertion holes 311 in the flange portions 31 are set at about 90° with respect to the center of the coil case 20.

Figure 6:
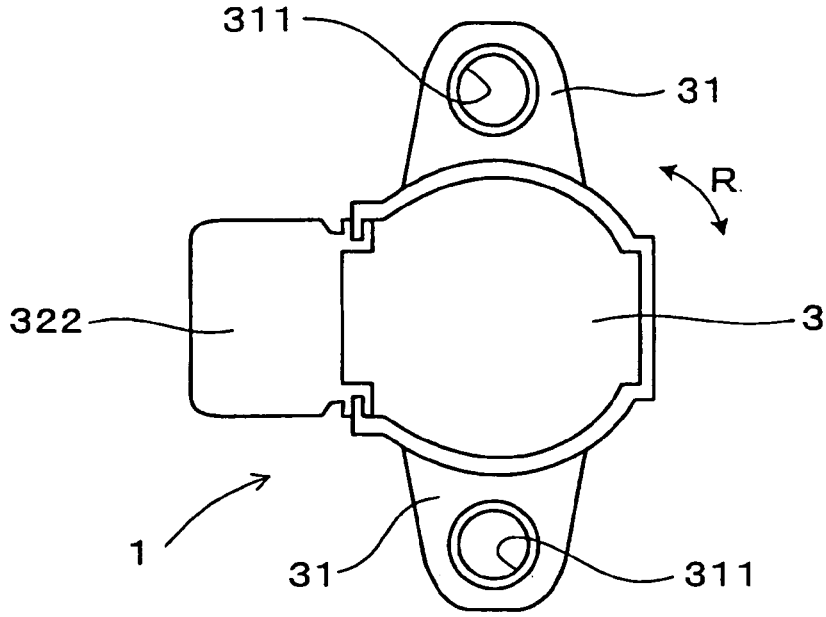
FIG. 6 is a top view showing the ignition coil having flange portions substantially radially opposed to each other, according to the first embodiment.

Alternatively, as shown in FIG. 6, the flange portions 31 may be arranged at two locations, which are apart from each other for about 180° with respect to the circumferential direction R of the igniter recession 3. In this structure, the angle between the centers of the bolt insertion holes 311 in the flange portions 31 are set at about 180° with respect to the center of the coil case 20.

Figure 7:
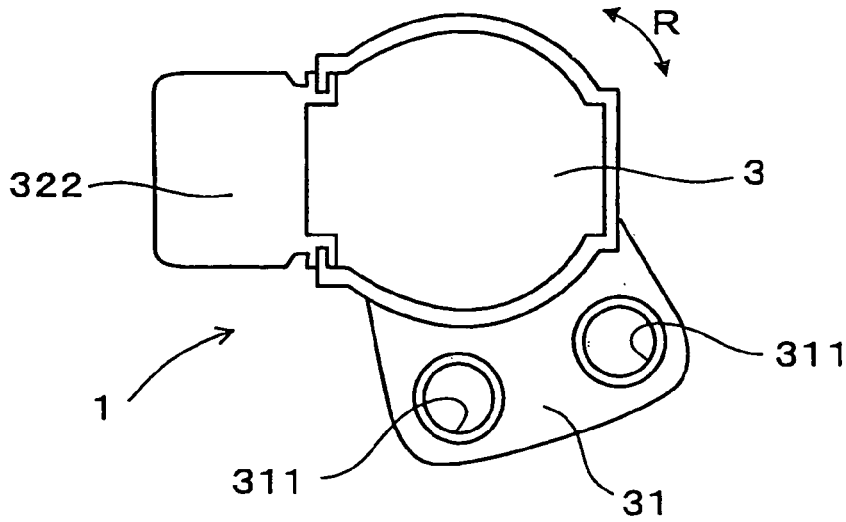
FIG. 7 is a top view showing the ignition coil having one flange portion, according to the first embodiment.

The bolt insertion holes 311 need not be individually formed in multiple flanges 31 respectively. As shown in FIG. 7, the bolt insertion holes 311 may be formed at two locations, which are apart from each other along the circumferential direction R of the igniter recession 3, in one flange portion 31.

Second Embodiment

Figure 8:
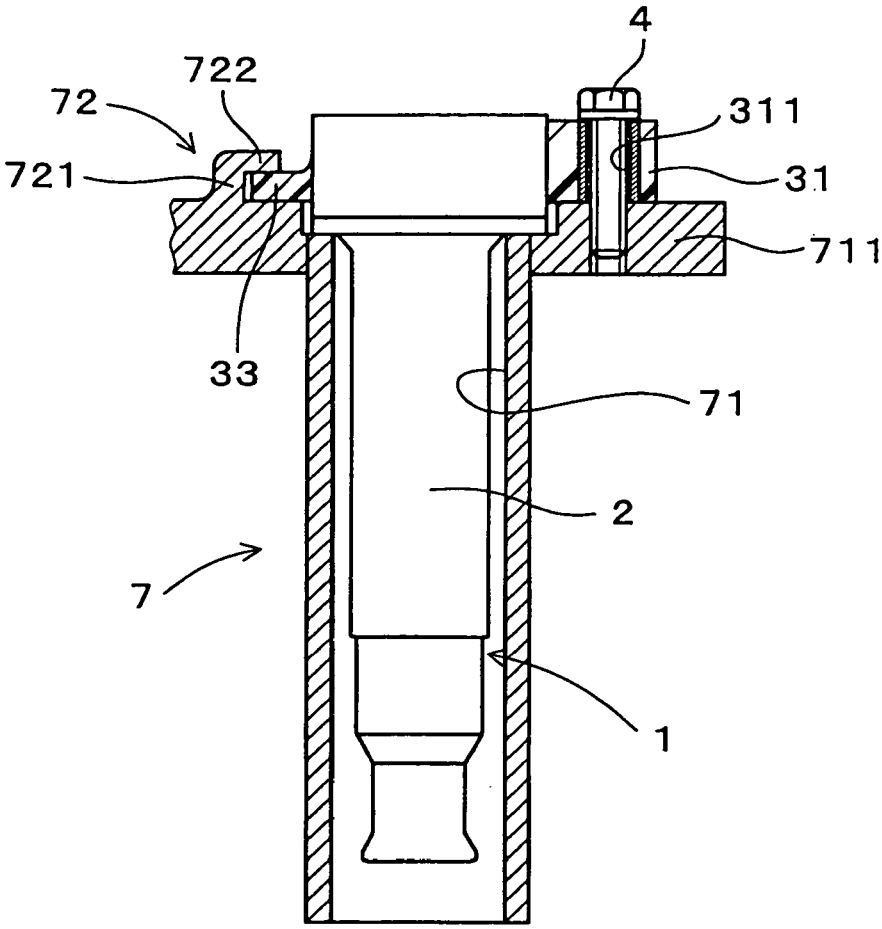
FIG. 8 is a partially cross sectional side view showing an ignition coil received in a plughole, according to a second embodiment of the present invention.

In this embodiment, as shown in FIG. 8, the ignition coil 1 includes the flange portion 31 and a hooking protrusion 33. The ignition coil 1 is secured into the plughole 71 of the engine 7 via the flange portion 31 and the hooking protrusion 33 that are secured around the plughole 71 of the engine 7. The flange portion 31 and the hooking protrusion 33 serve as hooking portions.

The flange portion 31 radially protrudes outwardly from the cylindrical portion 2. The flange portion 31 has the bolt insertion hole 311, through which the bolt 4 is inserted. The hooking protrusion 33 hooks to a hooked claw 72 that is provided around the opening of the plughole 7.

Figure 11:
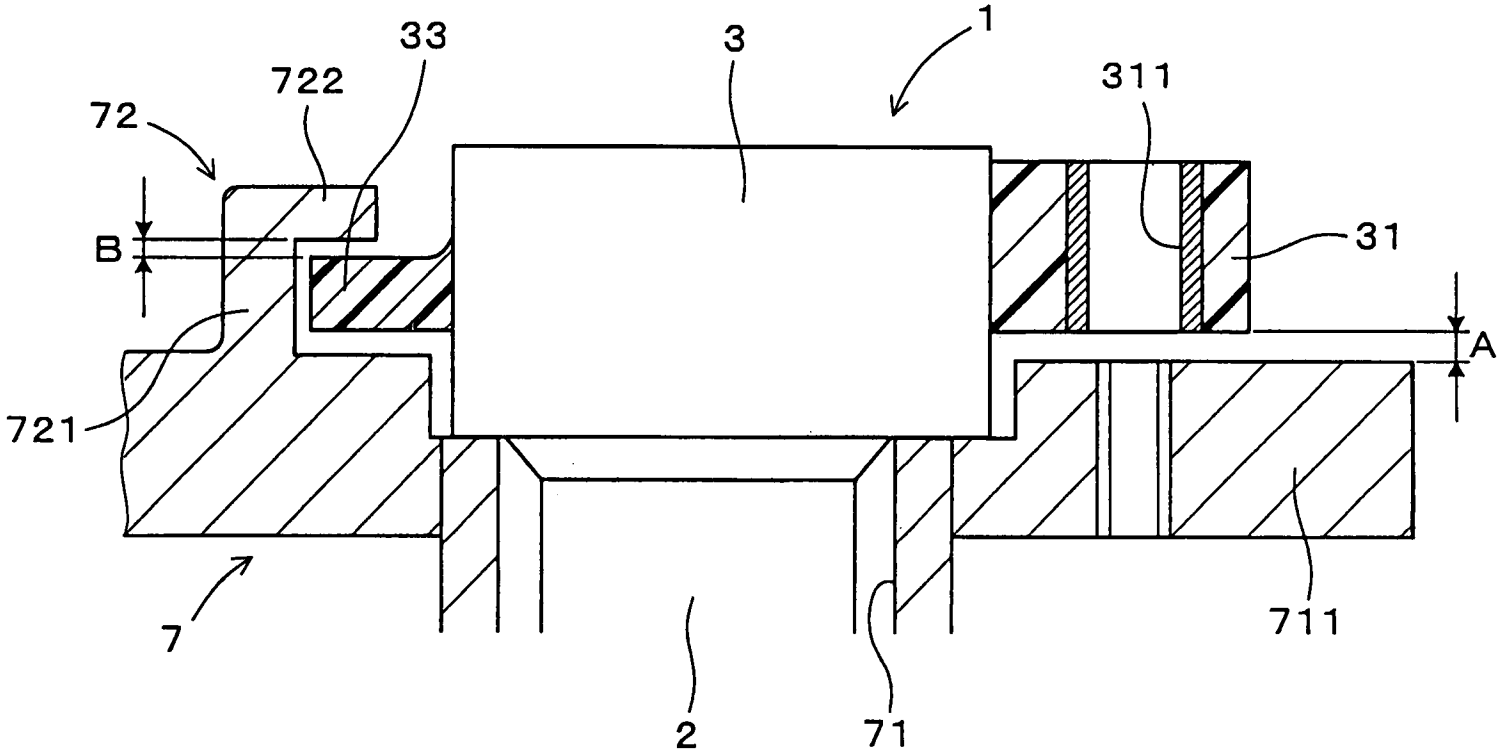
FIG. 11 is a partially cross sectional side view showing the ignition coil before being secured to an engine, according to the second embodiment.

As shown in FIGS. 8, 11, the hooked claw 72 is constructed of a rising portion 721 and a bent portion 722. The rising portion 721 rises from the engine-side flange portion 711. The bent portion 722 is bent from the rising portion 721, so that the bent portion 722 is arranged to oppose to the engine-side flange portion 711.

Figure 9:
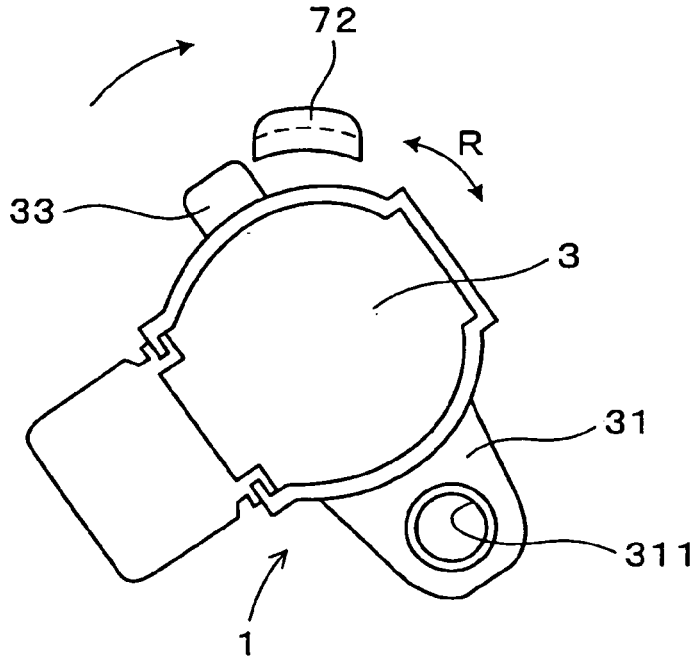
FIG. 9 is a top view showing the ignition coil having a flange portion and a hooking protrusion, according to the second embodiment.
Figure 10:
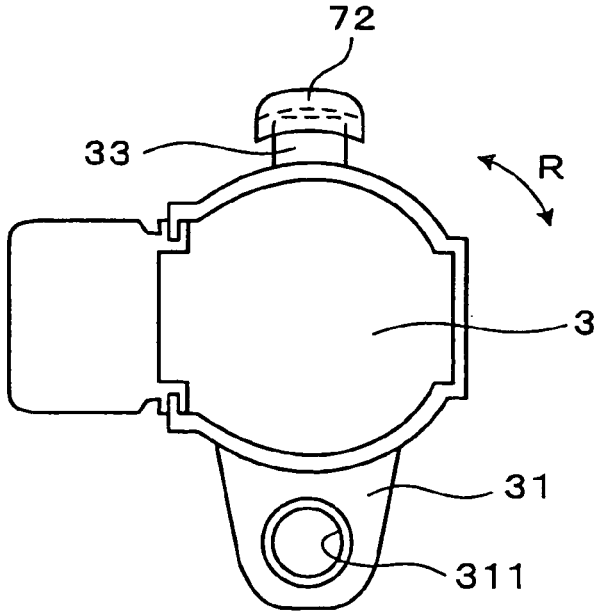
FIG. 10 is a top view showing the ignition coil having the hooking protrusion connected to a hooked claw, according to the second embodiment.

As shown in FIGS. 9, 10, when the ignition coil 1 is assembled to the engine 7, the cylindrical portion 2 of the ignition coil 1 is inserted into the plughole 71, subsequently the ignition coil 1 is rotated along the circumferential direction R, so that the hooking protrusion 33 is arranged in the hooked claw 72. In this situation, the hooking protrusion 33 is pressed toward the engine-side flange portion 711 by the bent portion 722 of the hooked claw 72. In this condition, the bolt 4 is inserted into the bolt insertion hole 311 of the flange portion 31, and the bolt 4 is screwed to the engine-side flange portion 711, so that the ignition coil 1 is mounted to the engine 7.

In this embodiment, the hooking protrusion 33 hooks to the hooked claw 72, so that an effect equivalent to the structure, in which the ignition coil 1 is secured using the bolt 4 can be produced.

Therefore, the coil spring 28 can be restricted from vibrating between the high voltage terminal 27 and the spark plug 6 in the ignition coil 1 by screwing the bolt 4 at one location. Thereby, production cost of the ignition coil 1 can be reduced, and working hours for installing the ignition coil 1 can be further reduced.

In this embodiment, structures other than the above hooking structure are equivalent to that in the first embodiment, and the structure of this embodiment can produce effects that are equivalent to those in the first embodiment.

As referred to FIG. 11, the cylindrical portion 2 of the ignition coil 1 is inserted into the plughole 71 of the engine 7, and the axial end face of a portion internally defining the igniter recession 3 makes contact with the axial end face of the plughole 71. In this situation, the flange portion 31 and the engine-side flange portion 711 form a gap A therebetween, and the bent portion 722 of the hooking protrusion 33 and the engine-side flange portion 711 form a gap B therebetween. The gap B is smaller than the gap A.

Figure 12:
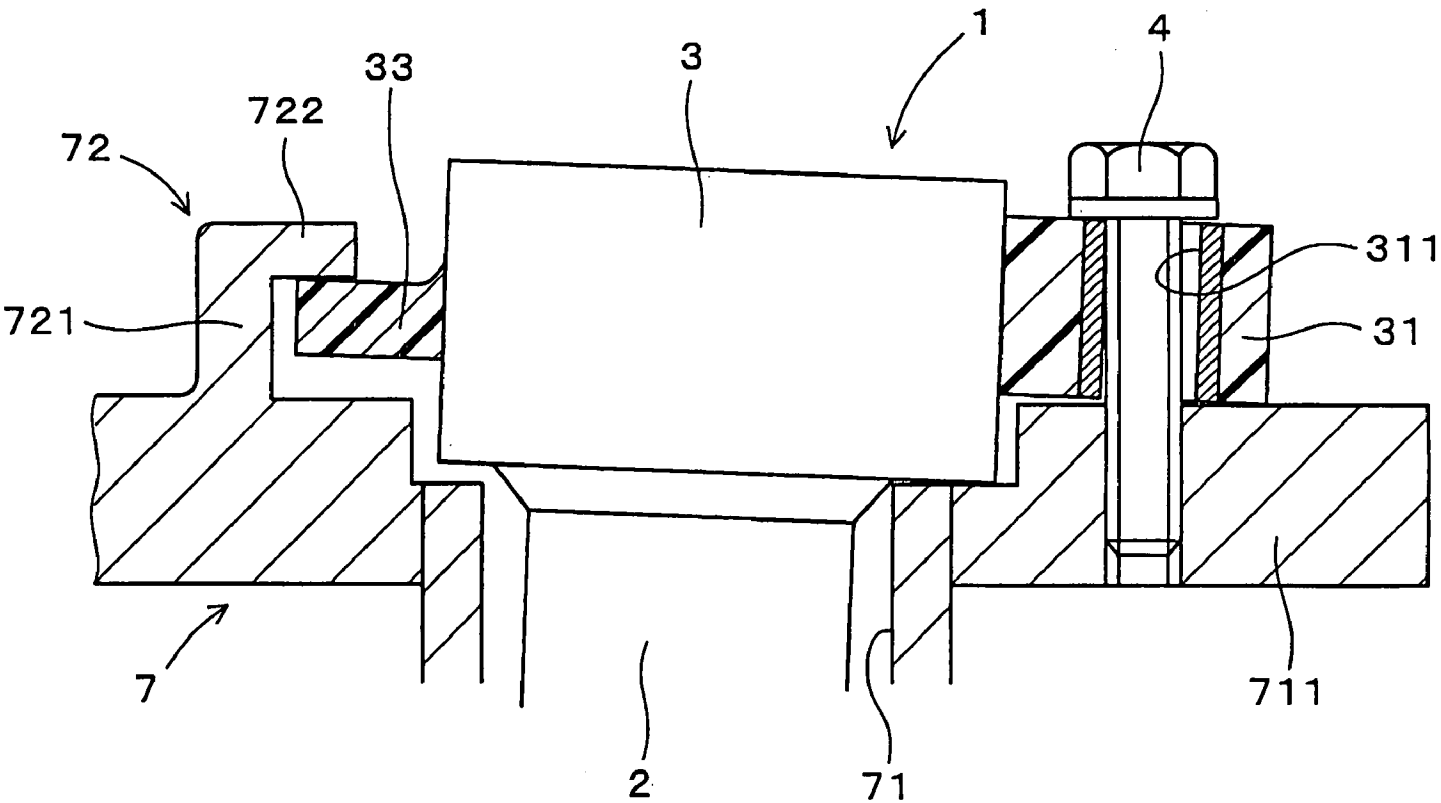
FIG. 12 is a partially cross sectional side view showing the ignition coil after being secured to the engine, according to the second embodiment.

As shown in FIG. 12, the bolt 4 is inserted into the bolt insertion hole 311 of the flange portion 31, and the bolt 4 is screwed to the engine-side flange portion 711. In this situation, the hooking protrusion 33 makes contact with the bent portion 722 of the hooked claw 72, and the flange portion 31 makes contact with the engine-side flange portion 711. Thus, the ignition coil 1 can be stably mounted to the engine 7.

Figure 13:
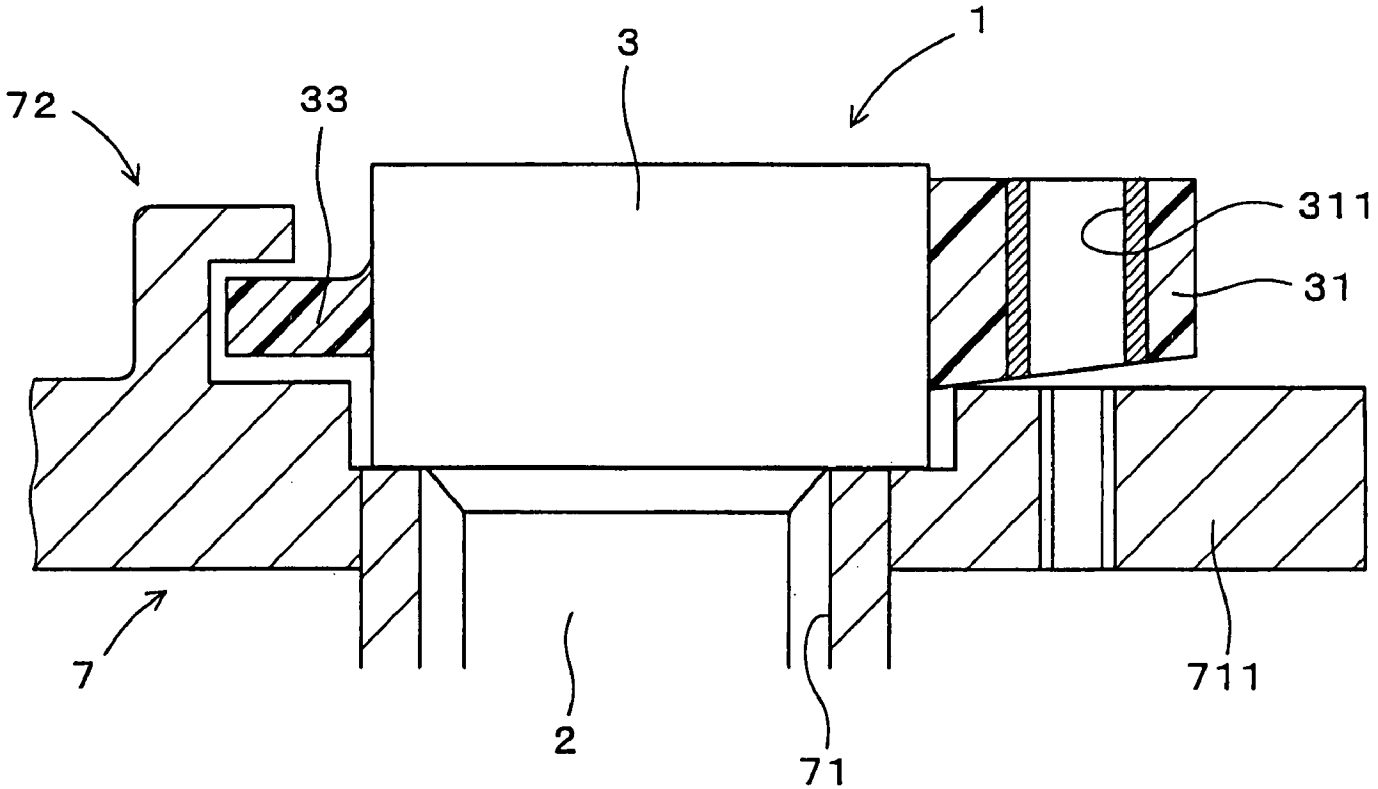
FIG. 13 is a partially cross sectional side view showing the ignition coil having a tapered flange portion before being secured to an engine, according to the second embodiment.

As shown in FIG. 13, the surface of the flange portion 31 on the opposite side of the engine-side flange portion 711 may be in a tapered shape. The tapered shape can be formed such that the thickness of the flange portion 31 becomes small toward the outer side in the radial direction of the cylindrical portion 2. The bolt 4 is inserted into the bolt insertion hole 311 of the flange portion 31, and the bolt 4 is screwed to the engine-side flange portion 711, so that the flange portion 31 can make contact with the engine-side flange portion 711 via the surfaces therebetween.

Figure 14:
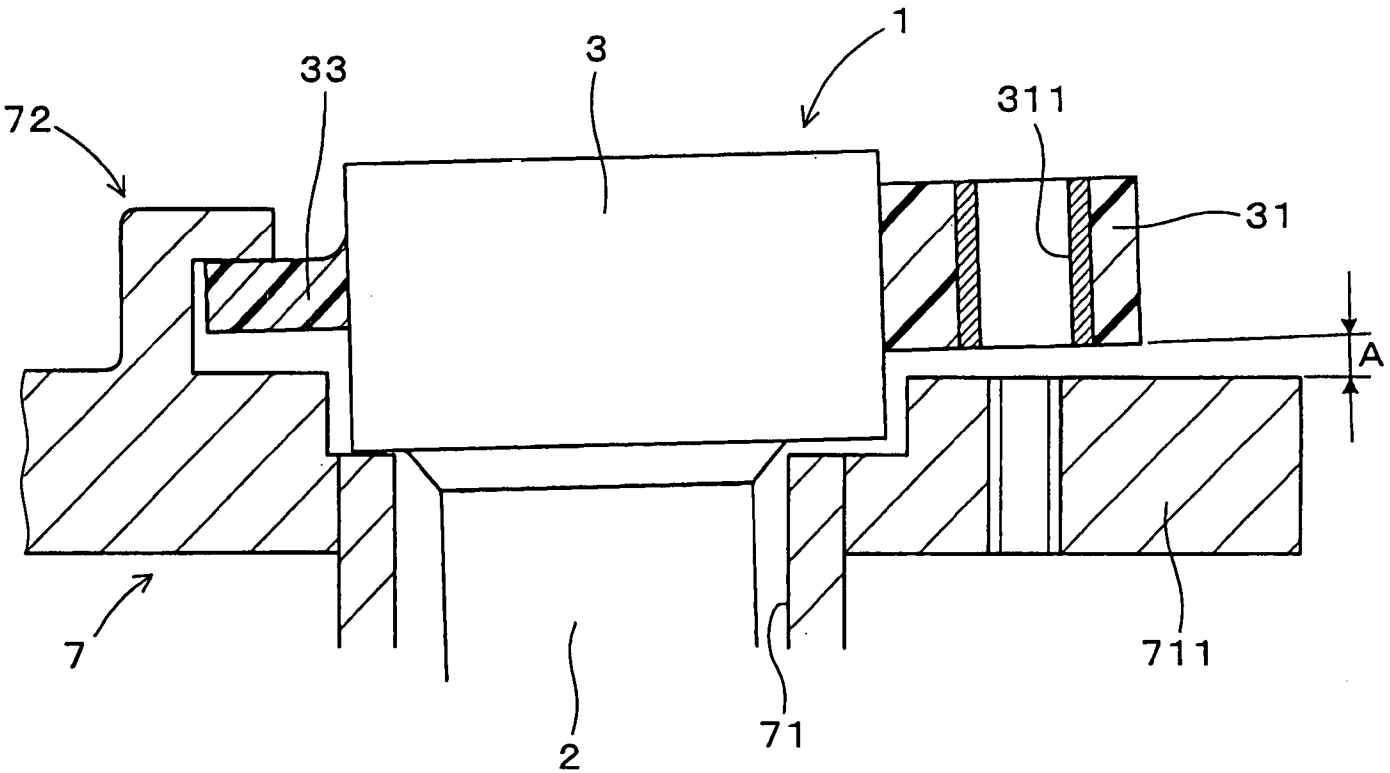
FIG. 14 is a partially cross sectional side view showing the ignition coil having the tapered flange portion before being secured to an engine, according to the second embodiment.

As shown in FIG. 14, the cylindrical portion 2 of the ignition coil 1 is inserted into the plughole 71 of the engine 7, and the axial end face of the portion internally defining the igniter recession 3 makes contact with the axial end face of the plughole 71. In this situation, the flange portion 31 and the engine-side flange portion 711 form the gap A therebetween. However, the bent portion 722 of the hooking protrusion 33 and the engine-side flange portion 711 may not form a gap therebetween.

Figure 15:
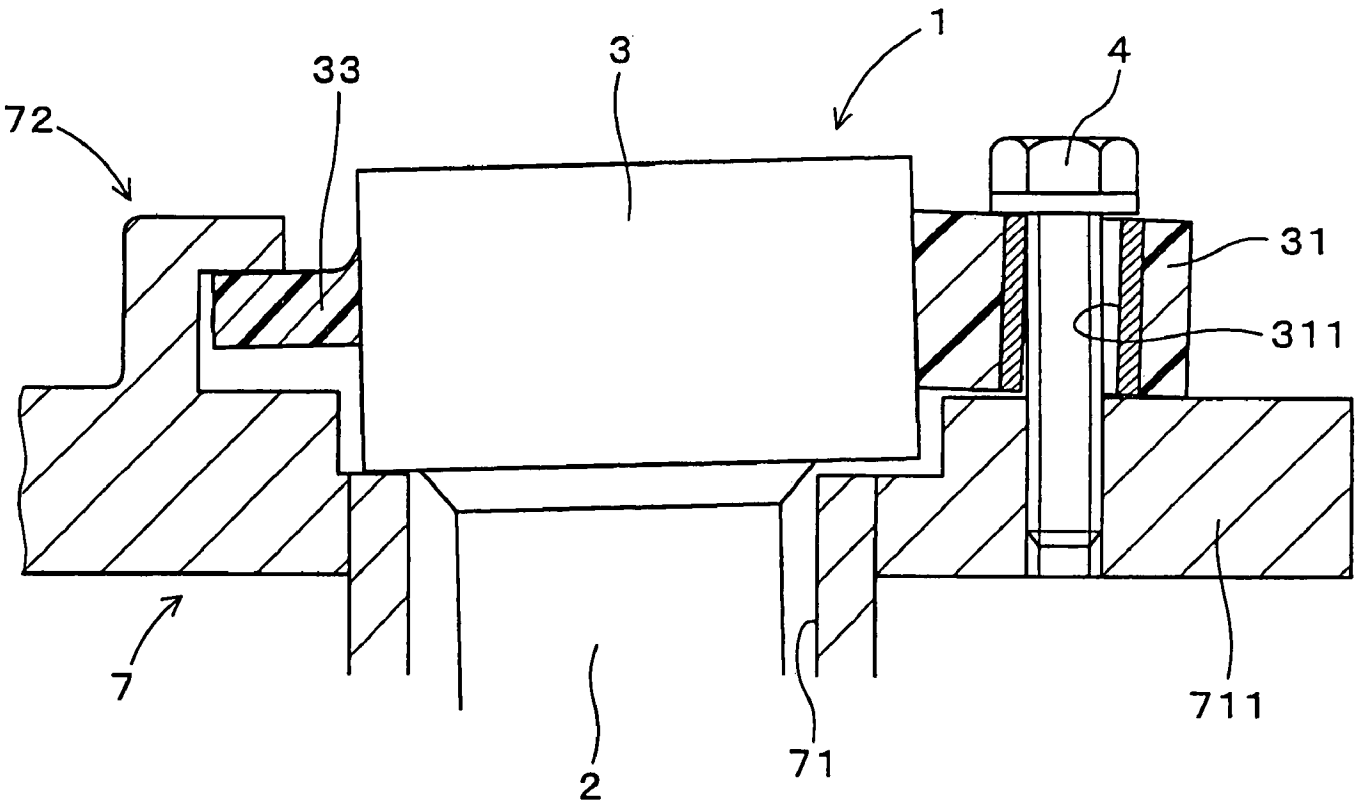
FIG. 15 is a partially cross sectional side view showing the ignition coil having the tapered flange portion after being secured to the engine, according to the second embodiment.

In this structure, as shown in FIG. 15, when the bolt 4 is inserted into the bolt insertion hole 311 of the flange portion 31, and the bolt 4 is screwed around the plughole 71, the hooking protrusion 33 makes contact with the bent portion 722 of the hooked claw 72, so that the ignition coil 1 can be further rigidly mounted to the engine 7.

In the above embodiments, the ignition coil includes the cylindrical portion. The ignition coil may include the ion current detecting device. The cylindrical portion includes the primary coil and the secondary coil. The secondary coil is wound coaxially with respect to the primary coil. The ion current detecting device detects ion current. The cylindrical portion is capable of being inserted into the plughole of the internal combustion engine. The cylindrical portion has the tip end in the axial direction of the cylindrical portion. The tip end of the cylindrical portion has the plug mounting hole, into which the sparkplug is mounted. The plug mounting hole accommodates the high voltage terminal that electrically connects with the secondary coil. The plug mounting hole accommodates the coil spring that makes contact with the high voltage terminal. The cylindrical portion has the base end portion in one end with respect to the axial direction of the cylindrical portion.

The base end portion of the cylindrical portion includes at least one flange portion. The at least one flange portion outwardly protrudes in the radial direction of the cylindrical portion. The at least one flange portion has the plurality of bolt insertion holes, through which one bolt is respectively inserted.

The above ignition coil is a stick-type ignition coil that has the cylindrical portion accommodating the primary coil and the secondary coil. The ignition coil is inserted into the plughole of the engine. In the above structures, the ignition coil does not have a conventional only one bolt screwing structure, in which one bolt is screwed to the engine to secure the ignition coil without any other securing members such as the hooking portion. The one bolt screwing structure may be advantageous in reduction of the number of components and in reduction of manufacturing cost. In the above embodiments, however, the ignition coil has the structure, in which multiple bolts are screwed to secure the ignition coil, or at least one bolt and at least one hooking protrusion are provided to secure the ignition coil. In these structures on the above embodiments, the mounting structure of the ignition coil is rigid compared with the conventional one bolt screwing structure.

When the sparkplug is mounted to the plug mounting hole of the ignition coil, the sparkplug electrically makes contact with the coil spring (spring member), so that a structure, in which electricity is supplied from the one end of the secondary coil to the sparkplug via the high voltage terminal, is constructed.

Alternatively, the base end portion of the cylindrical portion includes one flange portion. The one flange portion outwardly protrudes in the radial direction of the cylindrical portion. The one flange portion has the multiple bolt insertion holes, through which one bolt is respectively inserted. In this structure, multiple bolt insertion holes are formed in one flange portion. Therefore, the ignition coil is secured to the engine via multiple bolts, so that mechanical strength of the mounting structure can be enhanced.

Alternatively, the base end portion of the cylindrical portion includes multiple flange portions. The flange portions outwardly protrudes in the radial direction of the cylindrical portion. Each of the plurality of flange portions has one bolt insertion hole, through which one bolt is inserted. In this structure, one bolt insertion hole is formed in each of the multiple flange portions. The ignition coil is secured to the engine via multiple bolts, so that mechanical strength of the mounting structure can be enhanced.

Alternatively, the base end portion of the cylindrical portion includes multiple hooking portions that hook around the opening of the plughole of the internal combustion engine. The multiple hooking portions outwardly protrude in the radial direction of the cylindrical portion. The hooking portions are formed in locations, which are apart from each other in the circumferential direction of the cylindrical portion.

In this structure, the hooking portions are formed to secure the ignition coil. Therefore, the ignition coil is secured to the engine via the multiple supporting member (hooking portions), so that mechanical strength of the mounting structure can be enhanced.

In this structure, the plurality of hooking portions preferably includes at least one flange portion and at least one hooking protrusion. The at least one flange portion outwardly protrudes from the base end portion of the cylindrical portion in the radial direction of the cylindrical portion. The at least one flange portion has at least one bolt insertion hole, through which one bolt is respectively inserted. The at least one hooking protrusion hooks to the hooked claw that is provided around the opening of the plughole of the internal combustion engine.

In this structure, the at least one hooking protrusion hooks to the portion around the plughole, furthermore, the bolt is screwed to the portion around the plughole to secure the flange portion of the ignition coil, so that mechanical strength of the mounting structure can be further enhanced.

In the above embodiments, abrasion among the coil spring, the high voltage terminal, and the sparkplug can be effectively restricted in the above significantly simple structures.

When the primary coil of the ignition coil is energized, the secondary coil generates high voltage by electromagnetic inductance, so that the electrodes of the sparkplug generate a spark therebetween. Thereby, combustion is generated in the cylinder of the engine. The ion current detecting device detects ion current flowing between the electrodes of the sparkplug via the high voltage terminal and the coil spring.

In this situation, even when external force such as vibration is applied to the ignition coil, both the contact condition between the high voltage terminal and the coil spring and the contact condition between the sparkplug and the coil spring can be restricted from changing, by mounting the ignition coil to the engine via multiple bolts. Thereby, variation in electric resistance among the above components can be restricted. Thus, in the above embodiments, accuracy of detecting ion current can be significantly improved, so that a slight amount of ion current flowing between the electrodes in the sparkplug can be stably detected.

In the above structures of the ignition coil, one flange portion can be provided to the cylindrical portion, and at least two of the bolt insertion holes can be formed in the one flange portion. Alternatively, at least two of the flange portions can be provided to the cylindrical portion, and the bolt insertion hole can be respectively formed in each flange portion.

The bolt insertion holes are preferably formed in locations, which are apart from each other in the circumferential direction of the cylindrical portion. In this structure, the locations of the bolt insertion holes can be appropriately arranged, so that vibration of the coil spring between the high voltage terminal and the sparkplug can be further restricted.

The angle between the centers of the bolt insertion holes around the circumferential direction of the cylindrical portion is preferably in a range between 30° and 180°. In this case, the locations of the bolt insertion holes can be further appropriately arranged.

The high voltage terminal is preferably formed with the protrusion. The coil spring preferably has the inner periphery, into which the protrusion is press-inserted.

In this structure, the contact condition between the high voltage terminal and the coil spring can be further stably maintained, so that variation in resistance between the high voltage terminal and the coil spring can be further restricted, and the ion current can be further stably detected.

The coil spring has the tip end that makes contact with the outer periphery of the head portion of the sparkplug. The tip end of the coil spring is in the shape, which covers the outer periphery of the head portion of the sparkplug.

In this structure, the contact condition between the sparkplug and the coil spring can be further stably maintained without displacing from each other, so that variation in resistance between the sparkplug and the coil spring can be further restricted, and the ion current can be further stably detected.

The structures and methods of the above embodiments can be combined as appropriate.

Various modifications and alternations may be diversely made to the above embodiments without departing from the spirit of the present invention.

What is claimed is:

1. An ignition coil comprising:

a cylindrical portion that includes a primary coil and a secondary coil, the secondary coil being wound coaxially with respect to the primary coil; and an ion current detecting device that detects ion current, wherein the cylindrical portion is capable of being inserted into a plughole of an internal combustion engine, the cylindrical portion has a tip end in an axial direction of the cylindrical portion, the tip end of the cylindrical portion has a plug mounting hole, into which a sparkplug is mounted, the plug mounting hole accommodates a high voltage terminal that electrically connects with the secondary coil, the plug mounting hole accommodates a coil spring that makes contact with the high voltage terminal, the cylindrical portion has a base end portion in one end with respect to the axial direction of the cylindrical portion, the base end portion of the cylindrical portion includes at least one flange portion, the at least one flange portion outwardly protrudes in a radial direction of the cylindrical portion, and the at least one flange portion has a plurality of bolt insertion holes, through which a bolt is respectively inserted.

2. The ignition coil according to claim 1, wherein the high voltage terminal is formed with a protrusion, and the coil spring has an inner periphery, into which the protrusion of the high voltage terminal is press-inserted.

3. The ignition coil according to claim 2, wherein the coil spring has a tip end that makes contact with an outer periphery of a head portion of the sparkplug, and the tip end of the coil spring is in a shape, which covers the outer periphery of the head portion of the sparkplug.

4. An ignition coil comprising:

a cylindrical portion that includes a primary coil and a secondary coil, the secondary coil being wound coaxially with respect to the primary coil;

wherein the cylindrical portion is capable of being inserted into a plughole of an internal combustion engine, the cylindrical portion has a tip end in an axial direction of the cylindrical portion, the tip end of the cylindrical portion has a plug mounting hole, into which a sparkplug is mounted, the plug mounting hole accommodates a high voltage terminal that electrically connects with the secondary coil, the plug mounting hole accommodates a coil spring that makes contact with the high voltage terminal, the cylindrical portion has a base end portion in one end with respect to the axial direction of the cylindrical portion, the base end portion of the cylindrical portion includes one flange portion, the one flange portion outwardly protrudes in a radial direction of the cylindrical portion, and the one flange portion has a plurality of bolt insertion holes, through which a bolt is respectively inserted.

5. The ignition coil according to claim 4, wherein the plurality of bolt insertion holes is formed in locations, which are apart from each other in a circumferential direction of the cylindrical portion.

6. The ignition coil according to claim 4, wherein the high voltage terminal is formed with a protrusion, and the coil spring has an inner periphery, into which the protrusion of the high voltage terminal is press-inserted.

7. The ignition coil according to claim 6, wherein the coil spring has a tip end that makes contact with an outer periphery of a head portion of the sparkplug, and the tip end of the coil spring is in a shape, which covers the outer periphery of the head portion of the sparkplug.

8. An ignition coil comprising:

a cylindrical portion that includes a primary coil and a secondary coil, the secondary coil being wound coaxially with respect to the primary coil;

wherein the cylindrical portion is capable of being inserted into a plughole of an internal combustion engine, the cylindrical portion has a tip end in an axial direction of the cylindrical portion, the tip end of the cylindrical portion has a plug mounting hole, into which a sparkplug is mounted, the plug mounting hole accommodates a high voltage terminal that electrically connects with the secondary coil, the plug mounting hole accommodates a coil spring that makes contact with the high voltage terminal, the cylindrical portion has a base end portion in one end with respect to the axial direction of the cylindrical portion, the base end portion of the cylindrical portion includes a plurality of flange portions, the plurality of flange portions outwardly protrudes in a radial direction of the cylindrical portion, and each of the plurality of flange portions has one bolt insertion hole, through which a bolt is inserted.

9. The ignition coil according to claim 8, wherein the high voltage terminal is formed with a protrusion, and the coil spring has an inner periphery, into Which the protrusion of the high voltage terminal is press-inserted.

10. The ignition coil according to claim 9, wherein the coil spring has a tip end that makes contact with an outer periphery of a head portion of the sparkplug, and the tip end of the coil spring is in a shape, which covers the outer periphery of the head portion of the sparkplug.

11. An ignition coil comprising:

a cylindrical portion that includes a primary coil and a secondary coil, the secondary coil being wound coaxially with respect to the primary coil;

wherein the cylindrical portion is capable of being inserted into a plughole of an internal combustion engine, the cylindrical portion has a tip end in an axial direction of the cylindrical portion, the tip end of the cylindrical portion has a plug mounting hole, into which a sparkplug is mounted, the plug mounting hole accommodates a high voltage terminal that electrically connects with the secondary coil, the plug mounting hole accommodates a coil spring that makes contact with the high voltage terminal, the cylindrical portion has a base end portion in one end with respect to the axial direction of the cylindrical portion, the base end portion of the cylindrical portion includes a plurality of hooking portions that respectively hooks around an opening of the plughole of the internal combustion engine, the plurality of hooking portions outwardly protrudes in a radial direction of the cylindrical portion, and the plurality of hooking portions is formed in locations, which are apart from each other in a circumferential direction of the cylindrical portion.

12. The ignition coil according to claim 11, wherein the plurality of hooking portions includes at least one flange portion and at least one hooking protrusion, the at least one flange portion outwardly protrudes from the base end portion of the cylindrical portion in the radial direction of the cylindrical portion, the at least one flange portion respectively has at least one bolt insertion hole, through which a bolt is respectively inserted, and the at least one hooking protrusion hooks to a hooked claw that is provided around the opening of the plughole of the internal combustion engine.

13. The ignition coil according to claim 11, wherein the high voltage terminal is formed with a protrusion, and the coil spring has an inner periphery, into which the protrusion of the high voltage terminal is press-inserted.

14. The ignition coil according to claim 13, wherein the coil spring has a tip end that makes contact with an outer periphery of a head portion of the sparkplug, and the tip end of the coil spring is in a shape, which covers the outer periphery of the head portion of the sparkplug.

* * * * *